United States Patent [19]

Olmsted et al.

[11] Patent Number: 4,558,295

[45] **Date of Patent: * Dec. 10, 1985**

[54] TUNABLE-INDUCTANCE MAGNETICALLY-SOFT FERRITE CORE STRUCTURES

[75] Inventors: Robert W. Olmsted; Joseph F. Huth, III, both of Butler, Pa.

[73] Assignee: Spang & Company, Butler, Pa.

[ * ] Notice: The portion of the term of this patent subsequent to Apr. 16, 2002 has been disclaimed.

[21] Appl. No.: 439,371

[22] Filed: Nov. 5, 1982

[51] Int. Cl.[4] ..... H01F 15/02; H01F 21/06

[52] U.S. Cl. ..... 336/83; 29/608; 264/272.19; 336/136

[58] Field of Search ..... 29/602 R, 607, 608, 29/606; 264/67, DIG. 58, 272.19; 336/83, 130, 132, 134, 135, 136; 338/87

[56] References Cited

U.S. PATENT DOCUMENTS

| | | | |
|---|---|---|---|
| 2,297,437 | 9/1942 | Stapelfeldt | 336/136 X |
| 2,318,415 | 5/1943 | Patzschke et al. | 336/136 |
| 2,905,913 | 9/1959 | Leigh | 336/83 |
| 3,092,796 | 6/1963 | Maeda | 336/135 |
| 3,103,642 | 9/1963 | Fuller | 338/87 |
| 3,119,975 | 1/1964 | Arita | 336/136 |
| 3,267,401 | 8/1966 | Hotine et al. | 336/136 |
| 3,313,017 | 4/1967 | Zingali | 29/606 |
| 3,528,047 | 9/1970 | Iwata | 336/136 X |
| 3,593,245 | 7/1971 | Iwata | 336/83 |
| 4,150,278 | 4/1979 | Resener | 336/83 X |

FOREIGN PATENT DOCUMENTS

| | | | |
|---|---|---|---|
| 228447 | 5/1959 | Australia | 336/136 |
| 157326 | 10/1939 | Austria | 336/136 |
| 507196 | 12/1951 | Belgium | 336/136 |
| 1171096 | 5/1964 | Fed. Rep. of Germany | 336/136 |
| 1286235 | 1/1969 | Fed. Rep. of Germany | 336/136 |
| 1301400 | 8/1969 | Fed. Rep. of Germany | 336/136 |
| 870473 | 3/1942 | France | 336/136 |
| 1400837 | 12/1965 | France | 336/83 |
| 1431710 | 2/1966 | France | 336/83 |
| 2334189 | 1/1969 | France | 336/136 |
| 2315753 | 1/1977 | France | 336/136 |
| 815820 | 7/1959 | United Kingdom | 336/136 |
| 845375 | 8/1960 | United Kingdom | 336/136 |

*Primary Examiner*—Thomas J. Kozma
*Attorney, Agent, or Firm*—Raymond N. Baker

[57] ABSTRACT

New ferrite tuning assemblies are disclosed in which a unitary ferrite shaft is covered with a nonmagnetic material to provide a peripheral working surface for coacting with unitary helical thread means in the central opening of a core element to provide axial movement, for air gap adjustment purposes, by cutting and/or deforming at least a portion of the peripheral working surface of the tuning member. Various longitudinal and transverse cross-sectional configurations for the integral male tuning member are made available by the fabrication and assembly methods taught; assembly of inductance-tunable ferrite devices is facilitated by enabling insertion of a male tuning member into the central opening of either core element in an assembly and tuning from either longitudinal end of the aligned central openings.

1 Claim, 15 Drawing Figures

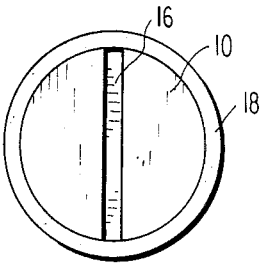
FIG. 1
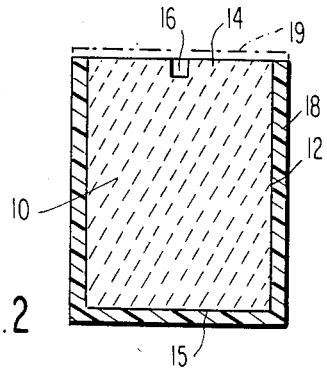
FIG. 2
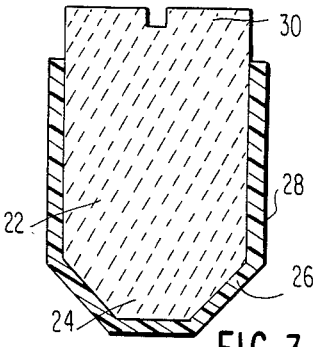
FIG. 3
FIG. 4
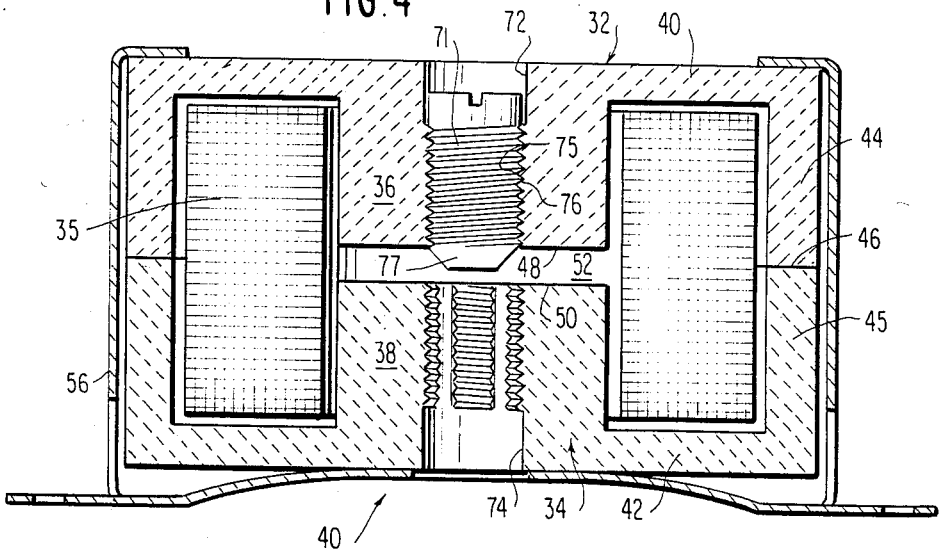
FIG. 5
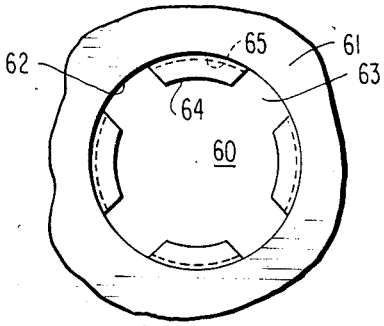
FIG. 6
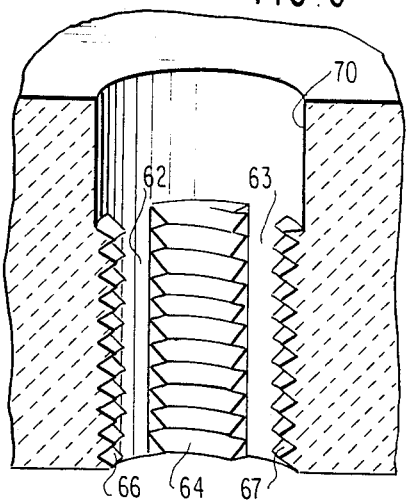

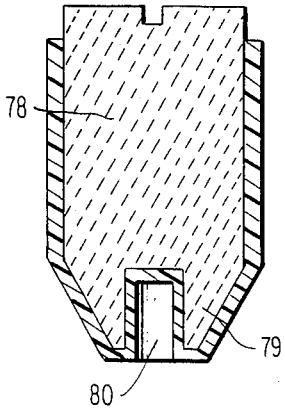
FIG. 7
FIG. 8
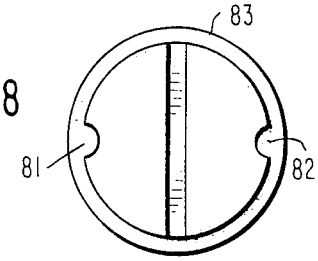
FIG. 9
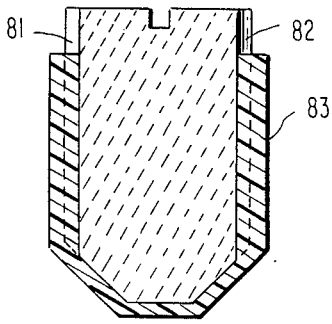
FIG. 10
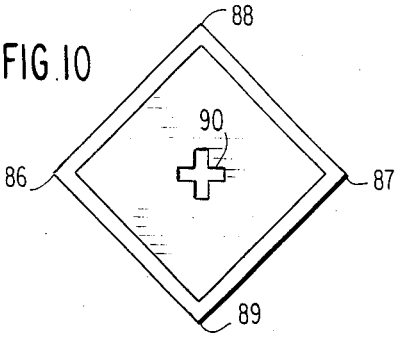
FIG. 11
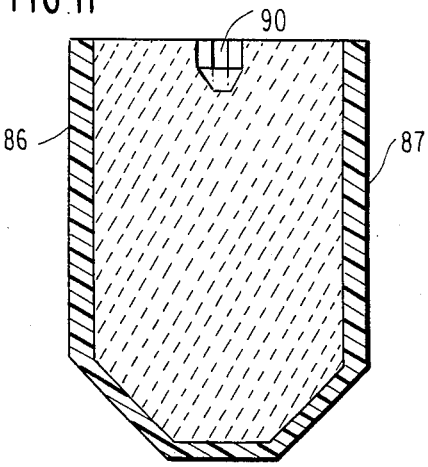
FIG. 12
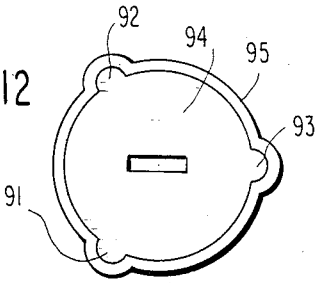
FIG. 13
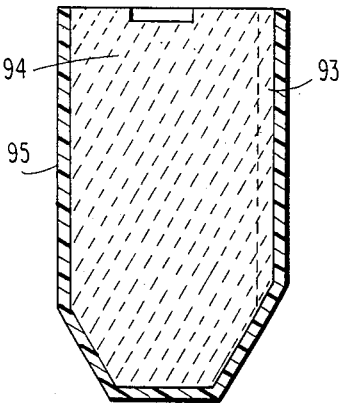

TUNABLE-INDUCTANCE MAGNETICALLY-SOFT FERRITE CORE STRUCTURES

This invention relates to tunable-inductance magnetically-soft ferrite core devices and, more particularly, to new tunihg assemblies and methods of manufacture.

Adjustable inductance devices utilizing magnetically-soft ferrite cores, referred to as adjustable pot cores, are assembled from core elements (halves) of substantially identical magnetic properties. Each core element includes a center post, a radially extending web at one longitudinal end of the post, and an outer wall skirt portion extending in spaced parallel relation to the center post. When a pair of such core elements are assembled, their center posts cooperate to provide a central support for a coil bobbin which places coil windings within the space defined between the central support and the skirt portions of the core elements.

The skirt portions are provided with mating surfaces in direct engagement defining one substantially continuous flux path and the center posts of the two core elements have their opposed inner ends in longitudinally spaced relationship to provide an air gap in a flux path which is used for controlling the inductance of the coil.

In prior commercial practice, cylindrical central openings were formed in the center post portions of the core elements to provide for adjusting magnetic characteristics within the air gap. An elongated male tuning member was fabricated with a nonmagnetic portion having screw threads on its external peripheral surface and a shaft carrying a ferrite tuning slug. A separately-formed female part, made of nonmagnetic material, was internally threaded and was made integral with the central opening of one of the ferrite core elements. Rotating the externally-threaded male tuning member within the matching internal threads of the separately-formed nonmagnetic female part in the central opening of a ferrite core element moved the ferrite tuning slug axially and adjusted the inductance of the device.

Such male tuning members of the prior art were generally formed with multiple parts including an externally-threaded portion, an extension for holding a ferrite sleeve, and a retainer for holding the ferrite sleeve on the extension. The threaded portion, extension, and retainer were made from nonmagnetic material. Such multiple parts required multiple steps in fabrication and assembly of the male tuning member. And, multiple parts and multiple assembly steps were required for at least one of the core elements to provide a nonmagnetic female part with matching threads for receiving the male member.

The present invention teaches a new approach which reduces fabrication and assembly steps for a male tuning member, a core element for receiving the male member, and an inductance-tunable ferrite device. For example, in fabricating the male member, an elongated unitary ferrite shaft is molded to the length required for adjustment purposes within the aligned central openings of assembled core elements; a nonmagnetic material is applied to the ferrite shaft and no further fabrication or assembly steps are required for the male tuning member.

Additional contributions and advantages of the invention are considered more specifically in the description associated with the accompanying drawings; in which:

FIG. 1 is an end view of a male tuning member of the invention;

FIG. 2 is a longitudinal cross-sectional view of the male tuning member of FIG. 1;

FIG. 3 is a longitudinal cross-sectional view of another male tuning member of the invention;

FIG. 4 is a cross-sectional view of a tunable inductance device of the invention with the male member shown in elevation;

FIG. 5 is an end view of a central opening of a core element for use in the inductance device of FIG. 4;

FIG. 6 is a perspective view of a portion of the central opening of FIG. 5;

FIG. 7 is a longitudinal cross-sectional view of another male tuning member of the invention;

FIG. 8 is an end view of another male tuning member of the invention;

FIG. 9 is a longitudinal cross-sectional view of the male tuning member of FIG. 8;

FIG. 10 is an end view of another male tuning member of the invention;

FIG. 11 is a longitudinal cross-sectional view of the male tuning member of FIG. 10;

FIG. 12 is an end view of another male tuning member of the invention;

FIG. 13 is a longitudinal cross-sectional view of the male tuning member of FIG. 12;

Figure 14:
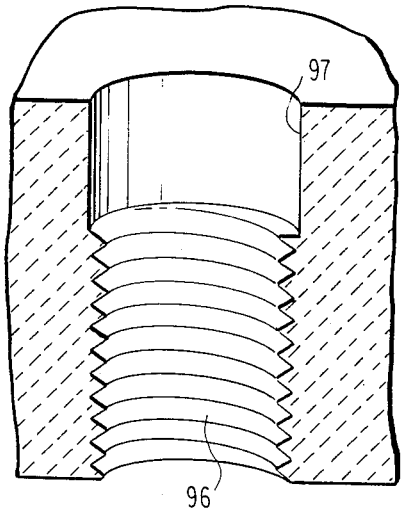
FIG. 14 is a perspective view of a portion of the central opening of a core element for receiving a male tuning member of the type shown in FIGS. 10 through 13.

The elongated ferrite shaft of the present invention is molded entirely from particulate ferrimagnetic material. After pressure molding, the unitary green compact is heated, driving off a binder used for molding, and sintered at elevated temperatures. The unitary ferrite shaft is at least partially encased in a nonmagnetic material. A slot for receiving an adjuster tool is molded into at least one longitudinal end of the ferrite shaft. The preforming of threads in the nonmagnetic casing is eliminated as a fabrication requirement for the male tuning member.

Referring to FIGS. 1 and 2, a longitudinally-extending unitary ferrite shaft 10 defines external side wall 12, head end 14, and distal end 15. A tool slot 16 is molded into the unitary ferrite at head 14.

After molding the green part and, sintering to form a ceramic, unitary ferrite shaft 10 is combined with nonmagnetic material 18, preferably a soft plastic, to form an integral male tuning member which is ready for use in a core assembly.

Nonmagnetic material 18 extends over at least a portion of the external side wall surface 12 of the ferrite shaft 10 to form a working surface for axial-movement purposes when the integral male tuning member is inserted into the central opening of a core assembly. The combined ferrite material and nonmagnetic material along the main body portion between longitudinal ends present a predetermined cross-sectional dimension, measured in a plane perpendicular to the longitudinal axis of the shaft, which is relied on for controlled axial movement of the male tuning member.

Nonmagnetic material 18 is preferably applied by coating a plastic on ferrite shaft 10. e.g. by dip coating shaft 10 in molten plastic in single or multiple stages, followed by cooling and solidification, to develop the desired side wall thickness for nonmagnetic material 18 and the desired outer dimension for the male member.

Such coating with plastic can be carried out with conventional dip-coating techniques. Coating of the unitary ferrite shaft provides for simplicity of manufacture and tightness of fit. A thin coating of the plastic can extend over the head portion, for protective purposes, as shown by broken line 19 in FIG. 2; or coating can be limited to a selected side wall portion of the main body.

The male adjustment member shown in FIGS. 1 and 2 has a generally cylindrical configuration throughout its length. In practice, the configuration of the embodiment of FIG. 3 is preferred for ease of assembly of an electrical inductance device of the type shown in FIG. 4.

Referring to FIG. 3, unitary ferrite shaft 22 is molded to have a truncated cone exterior configuration at least in approaching one of its distal ends; as shown inductance-adjustment end 24 is longitudinally opposite to its head end. Nonmagnetic material 26 covers at least a portion of shaft 22 providing a working surface of predetermined transverse dimension along main body side wall portion 28 between the start of truncated cone portion 24 and head end 30. Such working surface, for stability purposes, generally extends over a major portion of the main body side wall.

Referring to FIG. 4, core elements 32, 34 are positioned in mating relationship as shown to define space for coil winding 35. The core elements 32, 34 include, respectively, center posts 36, 38, web portions 40, 42, and skirt portions 44, 45. When assembled with skirt surfaces in contacting relation as shown at 46, the distal ends 48, 50 of center posts 36, 38, respectively, are in spaced relationship providing air gap 52.

In assembled form, the core elements 32, 34 enclosing coil windings 35 are held together by conventional metal clamping means, such as 56, which can also provide for attaching the assembly to a circuit board.

Such core elements are molded from ferrimagnetic material under pressure with an axially-extending central opening. While in the green state, and before sintering, helically-oriented screw threads are tapped in the surface of the central opening. As shown in FIG. 4, the threads are tapped along the central opening surfaces contiguous to the distal ends of the center posts and a counterbore is formed at the entry end of the central opening.

The standard manufacturing processes for ferrimagnetic material result in small particle sizes e.g. about 200 mesh. Such particulate ferrimagnetic material held in a binder facilitates reliable tapping with a tapping element having longitudinally-directed flutes for receiving cuttings. Further details of a thread tapping tool and operation for green compacted ferrimagnetic material are set forth in applicants' copending U.S. application Ser. No. 439,372, entitled "Inductance Tuning Means and Methods of Manufacture", filed concurrently herewith, and are incorporated herein by reference.

The unitary threads tapped in the central opening of a core element while in the green state are hardened to a ceramic state by subsequent sintering. The working surface portion of the male adjustment member coacts with the hardended central opening helical threads, upon rotation of the male tuning member within the central opening, and the unitary ferrite shaft is adjusted axially so as to control the air gap of the assembled device.

In one embodiment of the core element, rotation of the male tuning member in the central opening cuts threads in the nonmagnetic working surface. Various cross-sectional configurations for the central opening of a core element can be provided to establish die means with axially-directed flutes for receiving nonmagnetic material cut from such working surface portion by rotation of the male member within the central opening. Such central opening flutes are provided by molding the green core element with reentrant portions extending axially along the central opening surface. Such reentrant portions are spaced a greater distance from the central axis than the intermediate non-reentrant portions in which threads are tapped.

A representative cross-sectional configuration for such a central opening die means is shown in FIG. 5. In central opening 60 of center post 61, reentrant portions such as 62, 63 are distributed around the periphery and separated by non-reentrant portions, such as 64. After compaction, helically-directed threads are tapped in the non-reentrant portions forming thread-cutting die means; the root portion of such threads is indicated by broken line 65.

A perspective view of a portion of the central opening of FIG. 5 is shown in FIG. 6. Helical-path threads are tapped in non-reentrant portions 64, 66, and 67 with flutes 62 and 63 extending axially intermediate such threaded portions. At the entry portion of the central opening, counterbore 70 is provided to facilitate entry and centering of a male tuning member. The diameter of counterbore portion 70 can be made slightly greater than that of the crest portions of the threads tapped in the non-reentrant portions. Contact along the main body sidewall provides desired stability, however, a peripheral portion of the male tuning member contiguous to the tool slot end can be made slightly enlarged so that interfitting with the counterbore adds to the stability of the male tuning member in the central opening.

The assembly of FIG. 4 utilizes core elements which have substantially identical central openings of the type shown in perspective in FIG. 6. Male adjustment member 71, of the type shown in FIG. 3, can be introduced into counterbore opening 72 at the top of the assembly, as shown, or into counterbore opening 74 at the bottom of the assembly; the male tuning member ferrite shaft can also be molded with a tapered configuration and tool slot at both its longitudinal ends to further simplify assembly.

During rotation of the male tuning member 71 within the central opening of core element 32, threads are cut in the predetermined outer diameter portion 75 of the male tuning member, along its outer working surface, by thread cutting die means 76; axial positioning of truncated end 77, due to such rotation, adjusts the air gap 52.

In accordance with the teachings of the invention, the unitary ferrite shaft can be molded in various configurations to provide differing tuning capabilities. For example, in FIG. 7, unitary ferrite shaft 78, with truncated cone end 79, is molded with a hollow recess 80. Configurations which quantitatively reduce the amount of ferrite moved axially into the air gap per revolution of the male tuning member, compared e.g. to that of the embodiments of FIGS. 2 or 3, provide for finer tuning capability.

For uniform tuning purposes, the cross-sectional configuration in a plane perpendicular to the central axis of a unitary ferrite shaft should be substantially symmetrical. When nonmagnetic material is added in the form of a sleeve, it can be helpful to provide peripheral means to prevent rotation of the unitary ferrite shaft within the sleeve during rotational adjustment; preferably, such means are provided during molding.

In the embodiment of FIGS, 8 and 9, shallow indentations, shown as longitudinally-extending slots 81, 82, are positioned in the periphery of the unitary ferrite shaft for holding the plastic sleeve. Such holding means should be symmetrically distributed and can be positioned in the truncated cone portion of the unitary ferrite shaft to serve an additional function in providing for finer tuning. Such holding means can also be used when the nonmagnetic material is applied by dip coating.

In a differing approach, the invention provides for reliable and accurate axial adjustment of the male tuning member without requiring die means in the central opening while continuing to eliminate the thread matching problems of the prior art. In such approach, helical threads, which are substantially continuous about the surface of the central opening of a core element, are tapped while the core element is in its green compacted state. The unitary ferrite shaft and/or the combined nonmagnetic material are prepared with protruding portions which individually occupy a small segment of the peripheral surface, and are symmetrically distributed and spaced from each other about the working surface periphery of the male tuning member. Such peripheral protrusions of nonmagnetic material are deformed by the continuous helical threads within the central opening of a core element during rotation of the male tuning member causing axial movement.

Various transverse configurations are provided for this purpose. For example, the unitary ferrite shaft can be molded with multi-lateral, linear-sidewall surface configurations such as the rectangular cross section shown in FIGS. 10 and 11. A triangular configuration, or cross-sectional configuration of more than four sides can also be used to provide the desired corner protrusions while maintaining symmetry. Such linear side wall configurations substantially eliminate concern for relative rotational movement between the ferrite shaft and the nonmagnetic material. The desired transverse cross section dimension for the male tuning member is preselected at corner portions of the cross section, such as opposite corner portions 86, 87 and 88, 89 of FIG. 10. Tool slot 90 is provided in a Phillips head configuration in the rectangular cross section embodiment shown in FIGS. 10 and 11.

In an embodiment of the type shown in FIGS. 12 and 13, at least three protrusions 91, 92 93 are symmetrically distributed peripherally about ferrite shaft 94. Such shaft protrusions are manifested in nonmagnetic covering 95; such protrusions of nonmagnetic material can be formed in other ways; the circumferential spacing between protrusions facilitates deformation without interferring contact between next adjacent protrusions.

The sidewall nonmagnetic covering, forming protrusions of the types shown in FIGS. 10–13, comprises the working surface for axial adjustment of the male tuning member. The transverse dimension of the shaft and nonmagnetic covering at these protrusions is preselected so that the protruding nonmagnetic material is deformed by continuous helical threads 96 (FIG. 14). A counterbore 97 is provided to assist in centering of the male tuning member. Tapering of the male tuning member as shown in FIGS. 11 or 13, or of the protrusions, facilitates entry into the continuous helical threads 96 and start of deformation of the protruding portions. With rotation of a male tuning member within the central opening, the helical threads 96 cause axial movement by deforming, or a combination of partially deforming and partially cutting, of the protrusions providing adjustment of the air gap.

Figure 15:
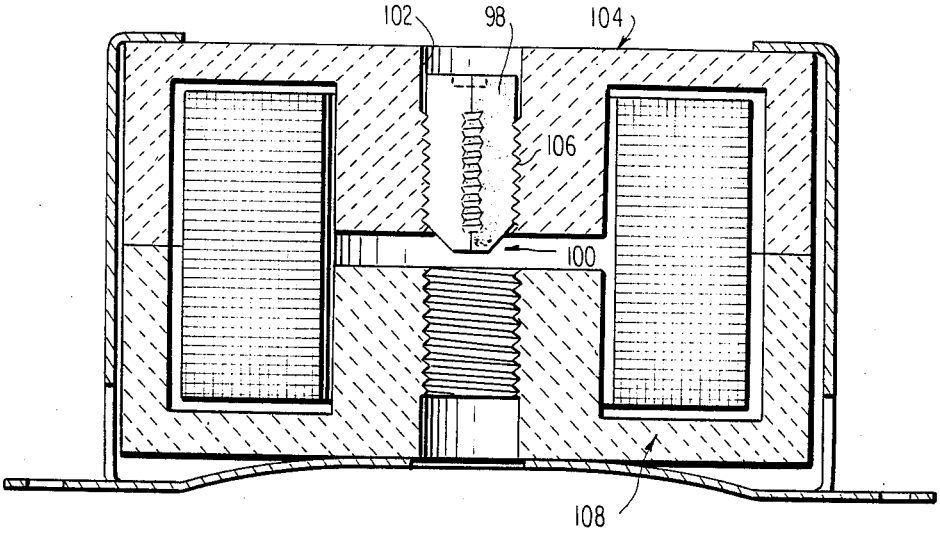
FIG. 15 is a cross-sectional view of a tunable-inductive device of the invention with the male tuning member shown in elevation.

In the ferrite assembly of FIG. 15, a male tuning member 98 of the type shown in FIG. 10 has been positioned to adjust air gap 100 by rotation within central opening 102 of core element 104 which presents unitary threads 106. Core element 108 is substantially identical to core element 104 so that only a single type of core element need be inventoried and the male adjustment member can be inserted through either core element of the assembly.

The thickness of the nonmagnetic material provided at the working surface is preselected to provide sufficient cutting and/or deformation by crest portions of the central opening screw threads means to control axial movement of the male tuning member without contact between the ferrite of the core element and the ferrite of the shaft; and without separating the nonmagnetic material into segments. The nonmagnetic material thickness can be selected to accommodate a thread height which has been typical for the separately-formed nonmagnetic female part of the prior art; e.g. with a thread height of about 0.008", the nonmagnetic material covering at the working surface should be above 0.015", preferably about 0.020".

The combined ferrite shaft and covering nonmagnetic material present a predetermined transverse cross-sectional dimension corresponding to the diameter of the central opening of the pot core element so to permit the coaction required for axial adjustment. Standard central opening diameters for widely used commercial sizes of the prior art type range from about 0.080" (0.079"±0.002") to about 0.2" (0.219"±0.004"). While not limited thereto; preselected transverse cross-sectional dimensions for integral male tuning members of the present invention cover such range. The unitary ferrite shaft within the integral male tuning member can have a transverse cross-sectional dimension in a range extending down to about fifty % of the outer dimension of the integral tuning member, depending on tuning capabilities desired.

However, the concepts of the present invention enable a wider range of selection of thread characteristics and other dimensional relationships than what was available in the prior art since thread matching and registration problems are eliminated while providing for accurate tuning.

A typical magnetically-soft ferrite material would have a compositional range of about 50 mole % $Fe_2O_3$
about 2–9 mole % FeO
about 31 to 36 mole % MnO, and
about 10 to 15 mole % ZnO.

Additives, which do not significantly alter the basic composition, as disclosed in the Goldman et al U.S. Pat. No. 4,097,392, can be made. The unitary ferrite shaft can be fabricated from the same ferrite or other magnetic material of desired permeability. Suitable ferrites are available from core manufacturers such as Spang Industries Inc., Butler, Pa. 16001.

The nonmagnetic portion of the male tuning member is preferably a soft plastic. Soft plastics exhibit both plastic and elastic characteristics. Engineering plastics of this nature are well known in this art and include, for example, polyester, polypropylenes and nylons. Suitable soft plastics exhibit sufficient rigidity to enable them to be cut or deformed while avoiding or minimizing stress in the ferrite of the pot core center post; and, also, exhibit elastic properties which provide a tightness of fit which helps to stabilize the position of the male member in a pot core central opening.

Other configurations for the male tuning member than those specifically illustrated are included within the teachings of the invention. For example, the male tuning member can be formed to be symmetrical in longitudinal cross section with a truncated conical configuration contiguous to both its longitudinal ends; such conically shaped exterior surface portions would be separated by a main body working surface of predetermined transverse cross-sectional dimension for cooperating with unitary threads in a core element; also, means for applying rotational force would be provided at both longitudinal ends so that the male tuning member could be inserted into, or adjusted from, either longitudinal end of the aligned central openings in an assembly.

In making ferrite core parts, ferrimagnetic material in particulate form is mixed with a binder such as gum arabic or polyvinyl alcohol for compaction into a green part. Compaction is carried out at pressures generally between about fifteen and thirty tons per square inch. The binder is burned off during heat treatment and sintering is carried out at temperatures generally in the range of about 1200° C. to 1400° C. Such compaction and heat treatment procedures, and suitable materials, are well known in the art.

Threads are tapped in a pressure compacted pot core element while in its green state before sintering to a ceramic state; the thread means within the central opening are unitary and eliminate the need for preforming threads in the male member and, in combination with other teachings of the invention, eliminate the thread matching, registry, and tolerance problems of the prior art.

The hardness factor for such ferrite ceramics, typically about eighty five to ninety five on the Rockwell "C" hardness scale, can be readily relied on to cut threads in and/or deform the nonmagnetic material used in the fabrication of male tuning members to provide the desired axial movement.

In light of the present teachings, other ferrite and nonmagnetic materials than those set forth and other configurations than those specifically described can be resorted to by those skilled in the art while relying on basic concepts of the invention; therefore, in determining the scope of the present invention, reference shall be had to the appended claims.

We claim:

1. Adjustable air gap ferrite pot core assembly comprising, in combination a pair of magnetically-soft ferrite pot core elements, each such core element including an elongated center post symmetrical about a centrally located longitudinal axis, a web extending in transverse relation to such axis contiguous to one longitudinal end of the center post, and a skirt extending from the web generally parallel to and in spaced relation from the center post defining a space for coil windings between the center post and the skirt, each core element skirt terminating in a mating surface for contacting the corresponding mating surface on the remaining core element skirt when in assembled relationship, the center post of each core element terminating in a distal end surface with such distal end surfaces of the pair of core elements being spaced axially from one another to define a predetermined air gap when the mating surfaces of the skirts of such pair of core elements are in contacting relationship, each core element center post presenting an internal wall surface defining a central opening, such central openings being in axial alignment when the pair of core elements are assembled for receiving an elongated air-gap adjustor for axially-directed movement within such central openings, unitary die means consisting of discontinuous helically-oriented threads for providing longitudinal movement along such core element central opening of an elongated air gap adjustor upon rotation within such unitary die means, such unitary die means being located along at least a portion of the internal wall surface of the central opening of at least one of such core elements, and an elongated air gap adjustor comprising in combination, an elongated unitary magnetically-soft ferrite shaft which is substantially symmetrical about its central longitudinal axis, and a nonmagnetic material integral with such unitary ferrite shaft establishing a nonmagnetic working surface circumscribing external periphery sidewall of such elongated unitary ferrite shaft intermediate its longitudinal ends, such nonmagnetic working surface presenting a substantially cylindrical configuration, such working surface nonmagnetic material being free of helical threads prior to being used within the central opening of an assembled ferrite pot core, such nonmagnetic material presenting in combination with such ferrite shaft a predetermined maximum transverse cross-sectional dimension for such working surface measured in a plane perpendicular to such central longitudinal axis, such predetermined transverse cross-sectional dimension enabling such adjustor to be cooperatively received within such unitary die means to provide for axial positioning of such adjustor upon rotation within such central opening.

* * * * *